US006411324B1

(12) United States Patent
Christiansen et al.

(10) Patent No.: US 6,411,324 B1
(45) Date of Patent: Jun. 25, 2002

(54) EDGE TO EDGE PRINTING METHOD AND APPARATUS FOR PRINTERS

(75) Inventors: Robert D. Christiansen; Kris R. Livingston, both of Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 1 day.

(21) Appl. No.: 09/691,450

(22) Filed: Oct. 18, 2000

(51) Int. Cl.[7] ..... B41J 2/435
(52) U.S. Cl. ..... 347/248; 347/234
(58) Field of Search ..... 347/218, 116, 347/234, 235, 248, 250; 382/175

(56) References Cited

U.S. PATENT DOCUMENTS 4,633,507 A * 12/1986 Cannistra et al. ..... 382/175
4,839,674 A * 6/1989 Hanagata et al. ..... 347/218
5,266,976 A * 11/1993 Ohigashi et al. ..... 347/116
5,374,993 A 12/1994 Diehl et al. ..... 358/300
5,758,234 A 5/1998 Binder et al. ..... 399/127
6,028,318 A 2/2000 Cornelius ..... 250/559.27

FOREIGN PATENT DOCUMENTS

EP 1029692 A1 2/1999 ..... B41J/2/505

* cited by examiner

*Primary Examiner*—Hai Pham
(74) *Attorney, Agent, or Firm*—James R. McDaniel

(57) ABSTRACT

Edge-to-edge printing in a laser or ink jet printer is accomplished by printing registration or calibration marks proximate to the edges of at least one page. The number of marks visible at each edge provides a measurable indication of the alignment of the print mechanism with respect to the page.

7 Claims, 3 Drawing Sheets

EDGE TO EDGE PRINTING METHOD AND APPARATUS FOR PRINTERS

BACKGROUND OF THE INVENTION

Laser printers are the printers of choice for delivering consistently high-resolution output text and graphics images. When used to print graphic images, laser printers can consistently deliver line resolutions approximating the resolution of photography.

In printing graphic images, a limitation of laser printers—as well as ink jet printers and even copiers—is the ability of the printer to accurately print close to the edge of a sheet of paper. Misalignment between the sheets of paper in a removable printer paper tray and a laser print engine makes it difficult for a laser printer, or for any other printer for that matter, to print edge-to-edge on a sheet of paper. Most laser printers can print as close as $1/6^{th}$ of an inch away from the edge of a page. A method and apparatus by which a printer can be enabled to accurately align a print mechanism so as to be able to print much closer to the edge of a page on which an image is to be printed, would be an improvement over the prior art. Edge-to-edge printing would enable a printer to print output graphics (e.g. photographs) that more closely resemble a photograph, which usually fills the photographic paper on which it is printed from one edge to another.

SUMMARY OF THE INVENTION

There is provided a method and apparatus for aligning a print mechanism, such as a laser print engine or an ink jet print head, to a page so as to enable the print mechanism to print text and images close to the page edge. As paper is fed into a printer, the placement of the paper with respect to the longitudinal travel limits of the print mechanism is unknown.

The method of one embodiment includes the steps of first moving the print mechanism to a left or right travel limit and then printing at least one alignment or registration image or mark beginning at the chosen travel limit, which is sufficiently large so as to be least partially printed onto the page—even if the page is severely misaligned with respect to the print engine. The print engine or other printing mechanism is then moved to the opposite travel limit whereat the alignment or registration mark is printed again. By comparing the two alignment marks that were printed, the alignment of the page with respect to the print mechanism can be determined. By examining the printed calibration page, which can be printed with an image as well as instructions, a user can enter one or more keystrokes at a printer control panel by which the printer's print engine alignment can be set.

A page that is perfectly aligned with the print mechanism will bear identical alignment marks at both margins. Print mechanism misalignment with respect to the feed paper is manifested by one alignment mark being greater or larger or otherwise different than the other mark. By manually (or automatically) re-positioning the print mechanism's starting point so as to cause the print mechanism to print equal amounts of both alignment marks on a page, the print mechanism of a printer can be closely aligned to a page edge thereby enabling the placement of printing much closer to the paper edge, even to the exact edge of a page.

DETAILED DESCRIPTION OF THE PREFERRED EMBODIMENT

Figure 1:
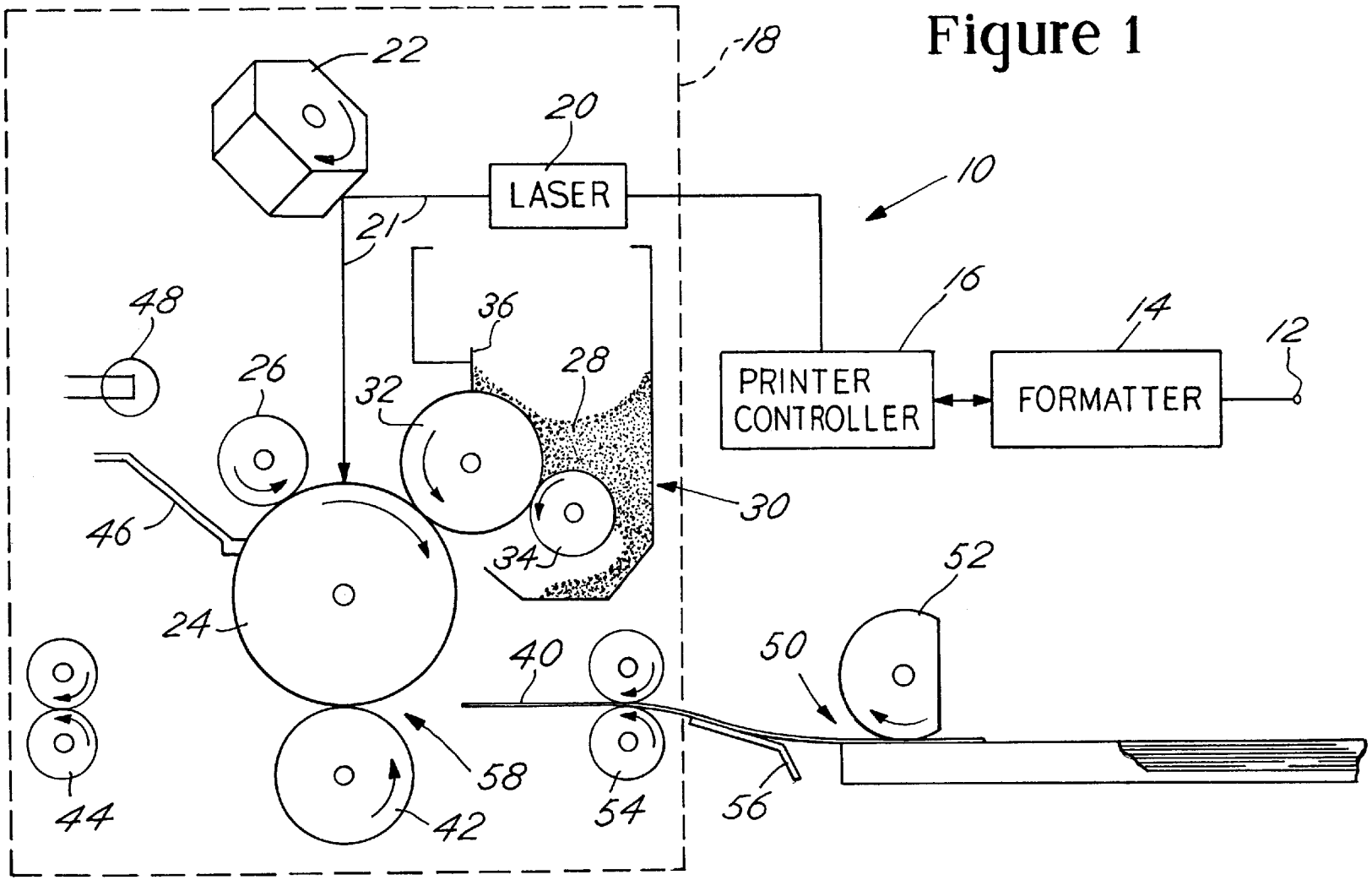
FIG. 1 shows an elevation view of a typical laser printer.

FIG. 1 shows an elevation of a typical laser printer mechanism 10.

A computer (not shown) transmits data representing a print image to an input data port 12 of the printer 10. The data is analyzed in a formatter 14, typically comprised of a microprocessor and related memory. The formatter 14 formulates and stores an electronic representation of each page to be printed. Once a page has been formulated, it is transmitted to the page buffer. The page buffer breaks the electronic page into a series of lines or strips one dot wide. This strip of data is sent to the printer controller 16, which also includes a microprocessor and which directs and manages the operation of the print engine 18.

Graphical and text images are deposited onto a page 40 by a light beam that is reflected off of a multifaceted spinning mirror 22. As the mirror 22 spins, it reflects or scans the beam of light across the surface of a photoconductive drum 24, which rotates on a motor-driven shaft such that the drum 24 advances just so that successive scans of the light beam off the mirror 22 is recorded on the drum 24 immediately after the previous scan. Electrically-charged toner particles 28 are captured by the photoconductive drum 24.

Images are transferred from the drum 24 to a paper 40 by positively charging the back side of a paper which causes negatively charged ink particles to transfer from a transfer roller 42 to the paper passing over the transfer roller 42. Output pages are passed through heated fusing rollers 44, thereby fusing the ink to the paper 40. A new sheet of paper is fed into a feed area 50 by a feed roller 52.

Misalignment between the print engine mechanism and the input paper trajectory typically limits the maximum page width upon which an image can be printed. By way of example, if the paper input tray is incorrectly mounted, or, if the paper in a tray is not fed in properly, or if paper handling rollers are misaligned or damaged, paper can be fed into the print engine at possibly different positions with respect to the print engine centerline as well as it's left and right travel limits resulting in the print engine printing an image slightly off of the page center. Edge-to-edge printing (printing across virtually an entire page width with little or no unprinted margin area) becomes problematic because the print engine 18 does not know where to begin printing to fully use the printable area of a page.

Figure 2:
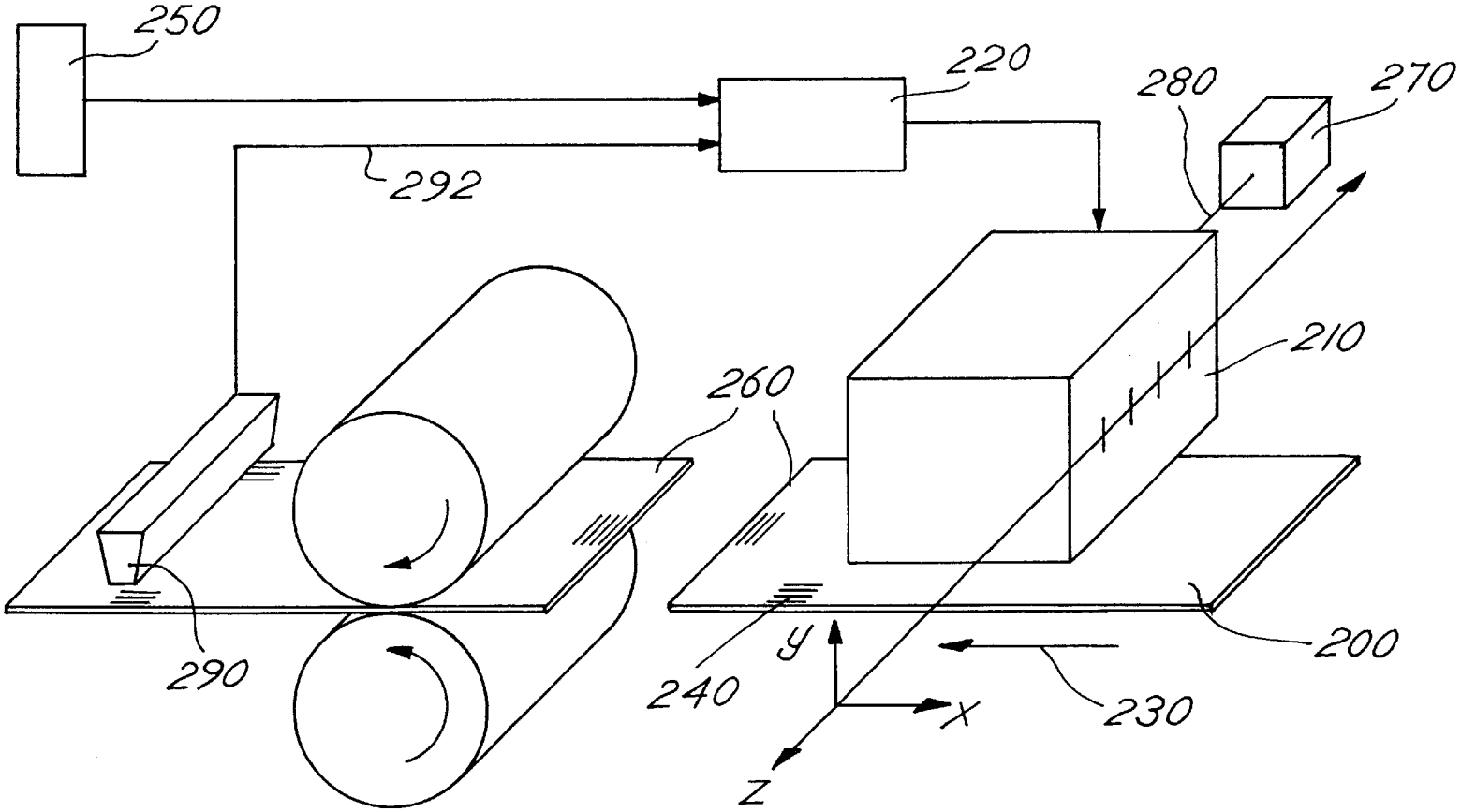
FIG. 2 depicts a simplified representation of a laser print mechanism that provides for the alignment of a print engine to the edges of a page.

FIG. 2 shows a simplified representation of a laser print mechanism for printing alignment or registration marks onto at least one page, by which the misalignment of the print engine with respect to the page center (and therefore the edges) can be determined and compensated for.

A sheet of paper 200 is fed into a printer mechanism from a paper source, such as, but not limited to a paper tray, hanging off of, attached to or suspended from the printer chassis (not shown). Rollers of the printer (see FIG. 1) not shown in FIG. 2 rotate so as to position the paper 200 under the print engine 210, depicted more explicitly in FIG. 1. Signals from a controller 220 to the print engine 210 determine where the print engine 210 will begin printing image material onto the page.

In at least one embodiment, the controller 220 instructs the print engine 210 to lay down a series of registration marks at both the left and right extreme limits of the print engine travel. The z axis shown in FIG. 2 depicts the direction of longitudinal "travel" of the print engine by which ink can be deposited across the width of the page which is carried through the printer in the direction of the arrow 230. In most laser printers, including the laser printer depicted in FIG. 1, the print engine 210 itself does not truly move along the z-axis, rather, it is the starting time of the light beam directed at the spinning mirror, (which is the laser printer element of the print engine that directs and determines placement of the beam and which in turn determines where an image will appear on an output page) that determines where along the photoconductive drum 24 that the light beam will be positioned. By controlling the rotation of the spinning mirror 22, as well as the timing of the laser light beam, images can be printed closer to or farther away from the edge of the photoconductive drum, which in turn determines where an image is placed on a paper to which the image is to be transferred.

In the preferred embodiment, and with respect to FIG. 1, the mirror 22 and/or laser light source 20 are operated by the controller 16 to place a first calibration or registration mark along the left margin of the paper. A complementary image is then printed along the right side of the page.

In the preferred embodiment, the calibration marks (also referred to as registration marks) that are printed by the print engine are a series of closely-spaced lines that run substantially parallel to the edges of the page being printed. The lines are printed by the mirror and/or laser being controlled to begin printing these lines at the left and right travel limits, i.e. at the extreme locations on the photoconductive drum 24—and sufficiently numerous so as to be printed onto the page even if the page is severely misaligned with respect to the print engine. In addition to printing registration marks along the side edges of a page, registration marks can be printed along the top and bottom edges of a page thereby enabling the printer to truly center an image on a page and print edge-to-edge along both directions of the print media.

In addition to parallel lines, other marks or images could be used as registration marks. Moreover, the lines do not necessarily need to be parallel to the print media edges. Any mark that is printed along an edge or margin, with a copy thereof printed along an opposing edge or margin, would provide a recognizable representation of the relative alignment of a print engine starting and stopping print locations.

In an ink jet printer, registration marks would be printed by the print head being moved to its left and right travel extremes to produce registration marks along the sides of a page. Similarly, the paper feed mechanism would send another page into the printer so that the print head would print alignment marks along the top and bottom page edges.

When the mirror and/or laser of a laser printer is operated to print the registration marks, toner will be transferred to the photoconductive drum 24 where the laser light impinged upon it, and then onto the paper 40, printing onto the paper, a number of lines that can be correlated to the relative position of the paper with respect to at least the photoconductive drum. In other words, the lines that actually appear at both sides of the page (or the top and bottom of a page) will provide a visual indication of the relative placement of the page with respect to the starting print position(s). In at least one embodiment, a user inspecting the calibration page can make print engine alignment adjusts by way of control signals input on a printer control panel.

In FIG. 2, a series of lines 240 is shown printed along the left-hand margin of the page 200. These lines 240 can be printed by literally moving a print mechanism to extreme travel limits (left and right) or by controlling a print mirror 22 (as shown in FIG. 1) or other print mechanism in order to lay down some sort of recognizable image (or images) or other icon that indicates where the paper lies with respect to the print mechanism. Whether the print mechanism is moved or is controlled to print registration marks at the left and right printing extremes are considered to be equivalent. If an equal number of lines are printed along the right-hand margin, it can be assumed that the page 200 is substantially centered with respect to the print engine 210. By knowing the number of lines that printed on the page at both margins, and by conveying such a metric to the print engine, it becomes feasible to print virtually to the page limit, without the print running off the edge of the paper and onto print engine rollers.

Figure 3A:
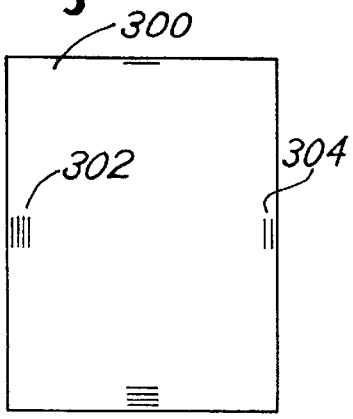
FIGS. 3A, 3B and 3C depict exemplary output pages by which a print engine can be aligned to a page edge.
Figure 3B:
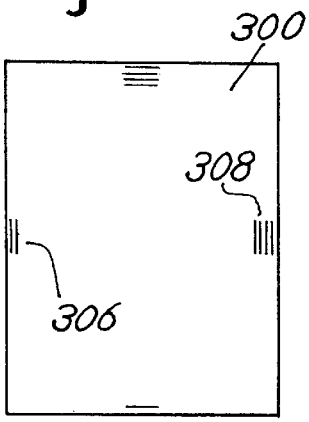
Figure 3C:
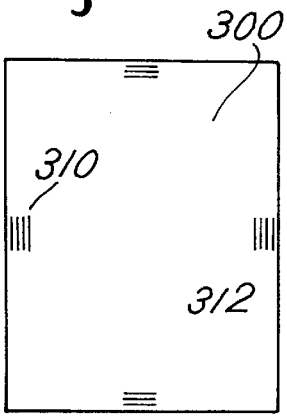

FIGS. 3A, 3B and 3C depict three different calibration pages and the calibration marks printed on them using the process described above. FIGS. 3A and 3B depict a calibration page showing the placement of calibration marks on misaligned sheets. FIG. 3C shows how the output of the printer would appear when the page is aligned with the print engine. The calibration marks provide a visual indication of how to provide adjust to a printer mechanism to align the mechanism to the page edges.

FIG. 3A shows an exemplary output calibration page 300 using the aforementioned process. Four (4) calibration lines 302 appear at the left-hand margin of the page 300 while there are only two (2) calibration lines along the right-hand margin. In FIG. 3B, which shows a second exemplary output calibration page 300, two (2) calibration lines or marks 306 appear along the left-hand margin. Four (4) calibration marks 308 appear along the right-hand margin. Finally, in FIG. 3C, which shows a third exemplary output calibration page, four (4) calibration lines (310, 312) appear at both the left and right-hand margins of the page 300.

Each of the pages depicted in FIG. 3 convey information about the relative alignment of the laser print engine mechanism that produced the pages. In FIG. 3A, the starting print position of the print engine is off-center and "lost" output off the right-hand side of the page. Accordingly, the print engine should be "aligned" to start printing sooner, or further left of the left edge of the paper 300. Appropriate command signals to the printer controller (element 16 in FIG. 1; element 220 in FIG. 2) will adjust the output print alignment leftward.

In FIG. 3B, print output was lost along the right-hand margin inasmuch as there were fewer lines on the left-hand side as on the right-hand side. An appropriate correction to center the print output would act to move the print starting point toward the right-hand side of the paper 300.

In FIG. 3C, there are an equal number of calibration marks along both left and right margins. That there are an equal number of such registration marks is a direct result of the placement of lines on the photoconductive drum 24 and demonstrates that the point (or time) at which printing was started, was substantially centered in the page 300. No calibration of the print engine starting point, or other adjustment is required to center subsequently printed pages.

Print starting-point correction (so as to align the print mechanism to the paper edges and therefore enable edge-to-edge printing) is accomplished in most laser printers by way of user-entered adjustment values. In FIG. 2, the printer controller 220 includes an input control terminal or control panel 250, typically accessible to the printer user and into which control commands can be entered.

By means of input commands to the control panel 250, the printer controller 220 can adjust the print engine 210 print starting points so as precisely align where the print engine 210 starts and stops printing across the page 200. By way of calibration lines 260 that can be printed across the top and bottom edges of the pages fed into the printer, the print engine 210 can also be adjusted to start and stop printing precisely at the top and bottom edges of the print media.

In other printers, an entire print engine might be longitudinally positioned on the z-axis shown in FIG. 2, using, for example a stepper motor 270 and threaded shaft 280, similar to the read/write head mechanisms used on disk drives. Other print head or print engine locator mechanisms would include mechanisms similar (or identical) to those used on ink jet printers, which includes cable wound around pulleys and wheels and rotated using either a stepper or other driver. For purposes of claim construction, moving an entire print mechanism, or re-calibrating the page position whereat it starts printing are considered to be equivalent operations under the moniker of adjusting the print position of the printer, print head, print engine or print mechanism.

In at least one embodiment, the calibration pages shown in FIGS. 3A, 3B and 3C will be printed with an advisory message assisting the printer user in calibrating the print engine. Such an advisory message would include any previous offset value that was entered during a previous calibration action. An operator can then input to the printer control panel 250, an appropriate signal to cause the controller 220 to reposition or re-locate the start and stop printing locations.

In another embodiment of the invention, the detection of the calibration marks on a calibration page can be accomplished using an optical scanner 290. As shown in FIG. 2, any appropriate optical scanner 290, which is positioned to "read" pages output from the print engine 210 can be used to sense or detect the calibration marks printed onto a calibration page. In such an embodiment, the toner can be read by the scanner, whether the toner is the same toner by which printed output is created, but might also include toner that is invisible to the human eye. As used herein, the term "toner" includes any sort of marking agent that might used in other printers and printing processes including, but not limited to: inks, waxes, dyes, including variants thereof that are not readily visible to the naked eye.

For purposes of claim construction, the detection of the registration marks by either an optical scanning device or by a human actually inspecting the printed calibration pages are considered to be equivalent steps of "comparing" the calibration marks printed onto at least one calibration page. Whether the calibration marks are printed using human-visible toner, or an ink visible only to a scanner are also considered to be equivalent operations, all under the rubric of "comparing" the various registration marks.

By appropriately programming the printer controller 220, signals from the scanner 292 can be used to detect the calibration marks, including their placement along the various edges of the media 200 on which they were printed. In such an embodiment, a print starting point calibration operation can be fully automated such that when calibration marks are laid down by the print engine, their placement on the page can be automatically detected by the scanner and controller, which reads the scanner output signals 292. The controller can thereupon issue appropriate correction signals to the print engine to print successive pages using the previously detected registration marks as indicators of where to start and stop printing so as to achieve full width output.

For purposes of claim construction, whether the starting and stopping print locations are set manually or automatically is considered to be equivalent operations generically described as "adjusting" the print position of the print engine or other print mechanism.

Figure 4:
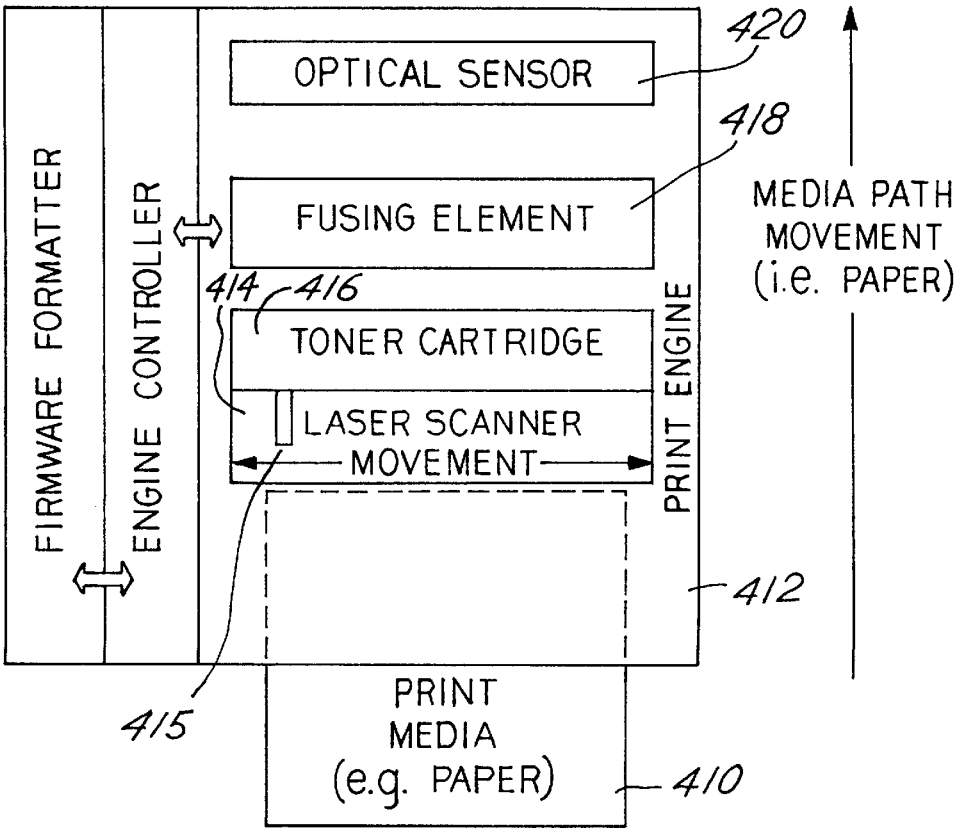
FIG. 4 shows another simplified diagram of a laser printer and the functional elements of a preferred embodiment.

FIG. 4 is yet another depiction of the arrangement of the functional elements of a laser printer 400 having an optical scanner or sensor to read or detect calibration marks.

Print media 410, which might include paper of any size that the printer mechanics can accommodate, is fed into the print engine 412. Within the print engine 412, the laser scanner is capable of traversing an area 414 substantially wider that the width of the print media. Within the laser's scanner movement area 414, there is a nominal starting point or margin 415 whereat the laser would begin scanning dots or elements onto a photoconductive element (not shown) so as to produce corresponding dots or elements onto the print media 410.

Toner from the toner cartridge 416 is deposited onto the print media 410. The deposited toner is subsequently fused by the fusing element 418 to fix the toner to the media.

When the media is output from the fusing element 418, it is optically scanned by a scanner 420 to detect where on the media the registration marks were deposited. If the registration marks are too far left or right, the starting print position 415 is changed so as to re-position subsequently printed pages (not shown).

In operation, the calibration or alignment marks are usually printed sequentially, i.e. the marks are first printed along one margin, then printed along another. For purposes of claim construction, the step of first printing the registration marks along a "right" margin or first printing them along "left" margin is considered to be equivalent as the orientation of "left" and "right" on a page passing through a printer is a relative term. Left and right have meaning only when the "top" and "bottom" are identified as well. In other words, printing the calibration marks first along a "left" edge or margin should be considered to printing the registration marks along the "right" edge or margin.

Those skilled in the art will recognize that the method disclosed herein is also useful to print edge to edge from the top to the bottom of a page. For this reason, a "left" edge or margin and a "right" edge or margin should be construed to be equivalent to and include a "top" and "bottom" edge or margin of a page.

While the preferred embodiment of the invention contemplates usage in a laser printer, the invention disclosed herein is equally useful to ink jet printers as well. By moving an ink jet print head to its left and right travel extremes and printing a series of registration (calibration) marks, the alignment of paper being fed into the printer with respect to the travel limits of the print head can be readily determined. An adjustment factor can then be sent to the printer from either the computer driving it, or, entered into the printer from a control panel or other input device whereby the control factor provides a control signal to the printer instructing it where along the width (or height) of a page it needs to start and stop printing so as to enable edge-to-edge printing.

In addition to printing lines as calibration marks, other symbols, patterns or images could be used and printed at both the top, bottom and sides of a printed page, without departing from the scope of the invention. Any recognizable image, the portion of which is discernible would provide equal functionality to the lines disclosed herein.

By laying down recognizable calibration marks at the top, bottom and left and right sides of a print media, the alignment of the printing mechanism with respect to the edges can be readily determined. The starting and stopping points of the print mechanism can thereupon be adjusted so as to allow edge-to-edge printing, enabling nearly photographic output on a printed media.

What is claimed is:

1. In a printer, a method of aligning a print engine to a plurality of page edges of paper fed to said printer from a paper source comprising:

printing a first calibration mark proximate to a first margin of said first page, wherein said first margin is a top margin of said first page;

printing a second calibration mark proximate to a second margin of said first page;

comparing said first calibration mark to said second calibration mark;

adjusting, if necessary, a print position of said print engine for subsequent pages based upon the results of comparing said first calibration mark to said second calibration mark.

2. The method of claim 1 wherein said step of printing a first calibration mark is comprised of the steps of:

positioning said print engine at a first printing limit; and printing a first predetermined number of spaced-apart lines, each of which is substantially parallel to the first margin, a number of which appear on a first edge of said first page.

3. The method of claim 1 wherein said step of printing a second calibration mark is comprised of the steps of:

positioning said-print engine at a second printing limit; and printing a first predetermined number of spaced-apart lines, which are substantially parallel to the second margin, a number of which appear on the second edge of said first page.

4. The method of claim 1 wherein said step of comparing said first calibration mark to said second calibration mark is comprised of the steps of:

determining a portion of said first calibration mark that is printed on said first page;

determining a portion of said second calibration mark that is printed on said first page;

determining a desired difference between said portion of said first and second calibration marks;

determining an actual difference between said portion of said first calibration mark and said portion of said second calibration mark; and comparing said actual difference with said desired difference.

5. The method of claim 1 wherein step of comparing said first calibration mark to said second calibration mark is comprised of the steps of:

optically scanning a portion of said first calibration mark that is printed on said first page;

optically scanning a portion of said second calibration mark that is printed on said first page;

determining a desired difference between said portion of said first and second calibration marks;

determining an actual difference between said portion of said first calibration mark and said portion of said second calibration mark from optical scans of said portions of said first and second calibration marks; and comparing said actual difference with said desired difference.

6. In a laser printer, a method of aligning a print engine to a plurality of page edges of paper fed to said printer from a paper source comprising:

printing a first series of spaced-apart calibration lines along a first margin of a first page;

printing a second series of spaced-apart calibration lines along a second margin of said first page;

counting a number of calibration lines printed along said first and second margins;

adjusting, if necessary, a print position of said print engine for at least a subsequently printed page to either the left or the right depending upon whether said number of calibration lines printed along said first margin was greater than said number of calibration lines printed along said second margin so as to print an equal number of calibration lines along both of said first and second margins;

wherein said first and second margins are left and right margins, respectively.

7. The method of claim 6 further including the steps of:

optically scanning said calibration lines along said left and right margins; and recognizing a number of scanned calibration lines along each margin and determining a difference, if any, between said number of calibration lines printed along said left margin and said number of calibration lines printed along said right margin.

* * * * *